US008376483B2

(12) United States Patent
Jung

(10) Patent No.: US 8,376,483 B2
(45) Date of Patent: Feb. 19, 2013

(54) ROTATABLE SHELF APPARATUS AND REFRIGERATOR HAVING THE SAME

(75) Inventor: Jae-Hun Jung, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 344 days.

(21) Appl. No.: 12/680,465

(22) PCT Filed: Sep. 8, 2008

(86) PCT No.: PCT/KR2008/005298

§ 371 (c)(1),
(2), (4) Date: Mar. 26, 2010

(87) PCT Pub. No.: WO2009/041764

PCT Pub. Date: Apr. 2, 2009

(65) Prior Publication Data

US 2010/0253197 A1 Oct. 7, 2010

(30) Foreign Application Priority Data

Sep. 28, 2007 (KR) ..... 10-2007-0098199

(51) Int. Cl.
*A47B 96/02* (2006.01)

(52) U.S. Cl. ..... 312/408; 211/153

(58) Field of Classification Search ..... 312/401, 312/408, 410, 228.1, 351; 108/108; 211/90.01, 211/90.02, 150, 153; 126/338; 62/382, 465
See application file for complete search history.

(56) References Cited

U.S. PATENT DOCUMENTS

| | | | | |
|---|---|---|---|---|
| 2,091,607 | A * | 8/1937 | Nave | 211/153 |
| 2,319,470 | A * | 5/1943 | Nobles | 211/153 |
| 2,564,478 | A * | 8/1951 | Harbison | 211/153 |
| 5,813,741 | A * | 9/1998 | Fish et al. | 312/408 |
| 6,663,204 | B2 * | 12/2003 | Atalla et al. | 312/408 |

FOREIGN PATENT DOCUMENTS

| | | | |
|---|---|---|---|
| JP | 9-217729 | A | 8/1997 |
| KR | 2000-0010932 | U | 6/2000 |
| KR | 20-0322788 | Y1 | 8/2003 |

* cited by examiner

*Primary Examiner* — James O Hansen
(74) *Attorney, Agent, or Firm* — Birch, Stewart, Kolasch & Birch, LLP

(57) ABSTRACT

A rotatable shelf apparatus and a refrigerator having the same. The refrigerator having the rotatable shelf apparatus includes a main body in which a storage space is formed, a rotatable shelf provided in the storage space to be rotated in a vertical direction, and a rotation supporting unit fixedly provided in the storage space to rotatably support the rotatable shelf. Therefore, it is possible to control the height of the storage space, to reduce the number of times of attaching and detaching the shelf in accordance with the size of accommodated food items, and to effectively utilize the storage space.

14 Claims, 3 Drawing Sheets

ROTATABLE SHELF APPARATUS AND REFRIGERATOR HAVING THE SAME

TECHNICAL FIELD

The present invention relates to a rotatable shelf apparatus and a refrigerator having the same, and more particularly, to a rotatable shelf apparatus capable of controlling the height of a storage space and a refrigerator having the same.

BACKGROUND ART

As well known, a refrigerator refrigerates or freezes food items so that the food items can be freshly kept. The refrigerator includes a main body in which a cooling chamber is formed and a refrigerating cycle apparatus for providing chilled air to the cooling chamber. The refrigerating cycle apparatus is formed of a vapor compressing refrigerating cycle apparatus including a compressor for compressing refrigerant, a condenser for emitting heat from the refrigerant to be condensed, an expansion device for reducing the pressure of the refrigerant so that the refrigerant expands, and an evaporator for the refrigerant absorbing peripheral latent heat so that the refrigerant evaporates.

On the other hand, a plurality of shelves are provided in the cooling chamber to vertically partition off the internal space so that food items can be accommodated and supported.

In the conventional refrigerator, since the shelves are provided to correspond to a width of the cooling chamber in right and left directions so that the both ends thereof are supported, when the food items or container having a larger height than the vertical distance between the shelves is to be accommodated, the upper shelf is to be separated to increase the vertical distance between the shelves or the food items or container is to be laid down.

In addition, since most of food items excluding some large food items are small, the upper space of the small food items cannot be utilized. Therefore, the amount of food items to be accommodated in the refrigerator is reduced.

In addition, the separated shelf cannot be easily kept and can be damaged and/or lost while the separated shelf is kept.

DISCLOSURE OF THE INVENTION

Therefore, it is an object of the present invention to provide a rotatable shelf apparatus capable of controlling the height of a storage space and a refrigerator including the same.

In addition, it is another object of the present invention to provide a rotatable shelf apparatus capable of reducing the number of times of attaching and detaching a shelf in accordance with the size of accommodated food items and of effectively utilizing a storage space and a refrigerator including the same.

In addition, it is still another object of the present invention to provide a rotatable shelf apparatus capable of vertically partitioning off a part of a storage space and a refrigerator including the same.

To achieve these and other advantages and in accordance with the purpose of the present invention, as embodied and broadly described herein, there is provided a refrigerator comprising a main body in which a storage space is formed and a rotatable shelf apparatus including a rotatable shelf provided in the storage space to be rotated in a vertical direction and a rotation supporting unit fixedly provided in the storage space to rotatably support the rotatable shelf.

The rotation supporting unit can comprise a rotary shaft formed in one of the main body and the rotatable shelf and a shaft hole formed in the other so that the rotary shaft is accommodated therein to move between a first position and a second position.

The rotation supporting unit can be provided in back and forth direction of the main body.

The rotatable shelf can have a width smaller than an entire width of the storage space in right and left directions, and a fixed shelf is provided on one side of the rotatable shelf in right and left directions of the storage space.

A lower supporting portion for supporting the rotatable shelf on the lower side of the rotatable shelf can be formed in the fixed shelf.

An upper supporting portion for preventing the rotatable shelf from being rotated upward on the upper side of the rotatable shelf can be formed in the fixed shelf.

A combination supporting unit can be formed in the fixed shelf so that the rotatable shelf can be horizontally combined.

The combination supporting unit can comprise a combination protrusion that horizontally protrudes from one of the rotatable shelf and the fixed shelf and a combination groove formed at the other so that the combination protrusion can be inserted therein.

The rotation supporting unit can further comprise a fixing unit for fixing the rotatable shelf in a vertical direction.

The fixing unit can comprise a locking protrusion that protrudes from one of the rotary shaft and the shaft hole toward the other and a locking groove formed in the other so that the locking protrusion can be accommodated therein.

A guiding portion for guiding the rotary shaft to be positioned in one of the first position and the second position can be formed in the shaft hole.

The guiding portion can be in the form of an arc having a radius of curvature corresponding to the external diameter of the rotary shaft.

The rotation supporting unit further comprises a supporting member provided on one side of the rotatable shelf in an axial direction.

The rotary shaft can be formed in the supporting member and the shaft hole can be formed in the rotatable shelf.

On the other hand, in another aspect of the present invention, there is provided a rotatable shelf apparatus comprising a rotatable shelf provided in a storage space to be rotated in a vertical direction and a rotation supporting unit fixedly provided in the storage space to rotatably support the rotatable shelf.

In addition, in still another aspect of the present invention, there is provided a rotatable shelf apparatus comprising a rotatable shelf provided in a storage space to be rotated in a vertical direction and a rotation supporting unit including a supporting member fixedly provided in the storage space, a rotary shaft formed to be protruding from one of the rotatable shelf and the supporting member, and a shaft hole formed in the other so that the rotary shaft is accommodated therein to move between a first position and a second position to rotatably support the rotatable shelf.

MODES FOR CARRYING OUT THE PREFERRED EMBODIMENTS

Reference will now be made in detail to the preferred embodiments of the present invention, examples of which are illustrated in the accompanying drawings.

Figure 1:
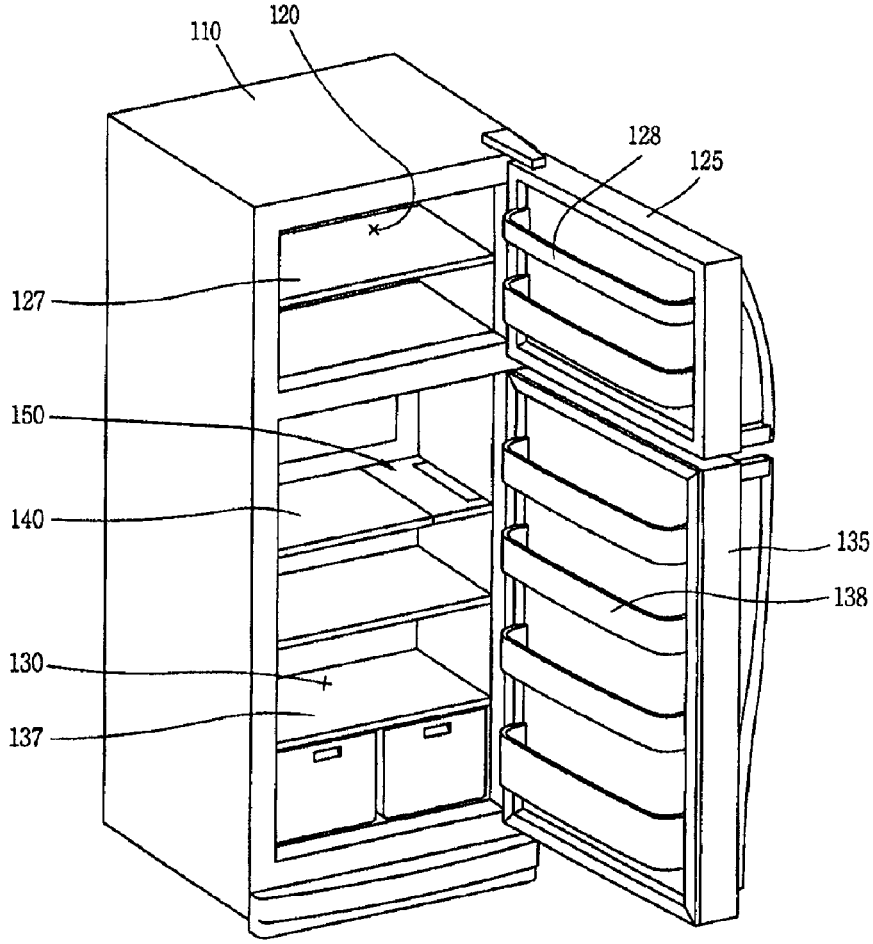
FIG. 1 is a perspective view of a refrigerator including a rotatable shelf apparatus according to an embodiment of the present invention.

As illustrated in FIG. 1, a refrigerator including a rotatable shelf apparatus includes a main body 110 in which a storage space is provided and a rotatable shelf apparatus 150 including a rotatable shelf 160 vertically and rotatably provided in the storage space and a rotation supporting unit 170 fixedly provided in the storage space to rotatably support the rotatable shelf 160. Here, the storage space of the main body 110 refers to a freezing compartment and a refrigerating compartment. According to the present embodiment, the freezing compartment is provided in the upper part of the main body 110 and the refrigerating compartment is provided in the lower part of the main body 110, which is referred to as a top freezer type refrigerator. However, a side by side type refrigerator or a bottom freezer type refrigerator can be provided. In addition, the rotatable shelf apparatus 150 can be provided in a freezing compartment 120 and/or a refrigerating compartment 130. Hereinafter, the case in which the rotatable shelf apparatus 150 is provided in the refrigerating compartment 130 will be described.

The freezing compartment 120 is provided in the upper part of the main body 110 and the refrigerating compartment 130 is provided in the lower part of the main body 110. A freezing compartment door 125 and a refrigerating compartment door 135 capable of opening and closing the freezing compartment 120 and the refrigerating compartment 130 are provided in front of the freezing compartment 120 and the refrigerating compartment 130. A refrigerating cycle (not shown) is provided in the main body 110 so that chilled air can be provided to the freezing compartment 120 and the refrigerating compartment 130. The refrigerating cycle can consist of a compressor for compressing refrigerant, a condenser for condensing the compressed refrigerant, an expansion device for reducing the pressure of the refrigerant to expand the refrigerant, and an evaporator absorbing latent heat to evaporate the refrigerant.

Shelves 127 and 137 are provided in the freezing compartment 120 and the refrigerating compartment 130, respectively, to partition off the internal space and to accommodate food items. A plurality of door pockets 128 and 138 are provided in the freezing compartment door 125 and the refrigerating compartment door 135, respectively, so that food items can be accommodated.

On the other hand, when the height of the food items stored in the refrigerating compartment 130 is large, the rotatable shelf apparatus 150 is provided so that the food items having a large height can be accommodated without separating the shelf 137 in the upper part.

Figure 2:
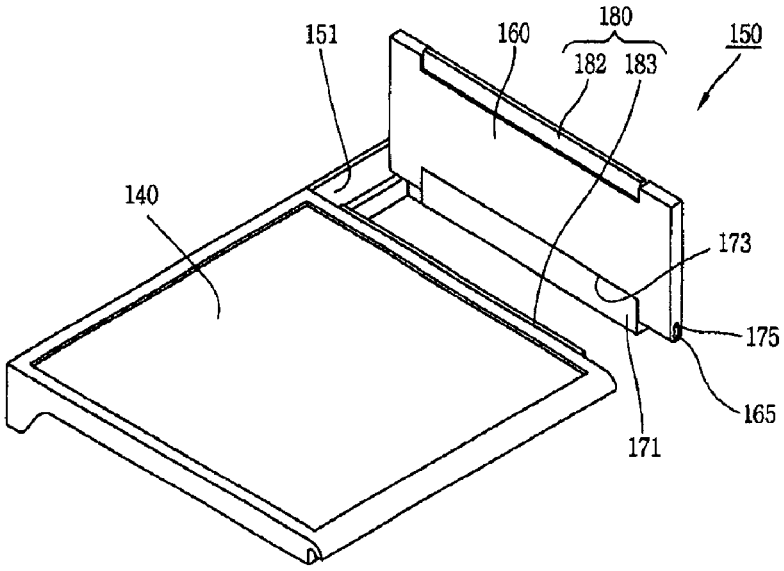
FIG. 2 is a perspective view of the rotatable shelf apparatus of FIG. 1.

As illustrated in FIG. 2, the rotatable shelf apparatus 150 includes the rotatable shelf 160 vertically and rotatably provided in the storage space, that is, in the refrigerating compartment 130 and the rotation supporting unit 170 fixedly provided in the refrigerating compartment 130 to rotatably support the rotatable shelf 160.

The rotatable shelf 160 is formed to have a width in right and left directions. Here, the width of the rotatable shelf 160 is narrower than the entire width of the storage space. The rotatable shelf 160 can be arranged so as to be rotatable with respect to the axial line disposed in back and forth directions of the main body 110. Therefore, the food items having a large height can be accommodated in back and forth direction in a row or in a plurality of rows. Here, the rotatable shelf 160 can be formed so that the axial line is provided in back and forth direction of the main body 110. In this case, food items having a large height such as bottles can be accommodated in right and left directions in one row or in a plurality of rows.

A fixed shelf 140 can be provided on one side of the rotatable shelf 160. Therefore, when the rotatable shelf 160 is rotated to be in a horizontal state, the rotatable shelf 160 can accommodate and support the food items in cooperation with the fixed shelf 140 or can independently accommodate and support the food items.

A frame 151 can be provided on one side of the fixed shelf 140 to support the fixed shelf 140.

The rotation supporting unit 170 includes a rotary shaft 175 provided in one of the main body 110 and the rotatable shelf 160 and a shaft hole 165 formed in the other so that the rotary shaft 175 is accommodated therein to move between a first position 166*a* and a second position 166*b*.

The rotary shaft 175 is separated from the rotatable shelf 160 and the shaft hole 165 is formed at the both ends of the rotatable shelf 160. Here, the rotary shaft 175 can formed at the both ends of the rotatable shelf 160 and the shaft hole 165 can be separated from the rotatable shelf 160.

A supporting member 171 in which the rotary shaft 175 is formed is provided on one end of the rotatable shelf 160. The supporting member 171 can be fixed to the main body 110. According to the present embodiment, the supporting member 171 is fixed to the frame 151.

The supporting member 171 can be formed to have a smaller length than the length of the rotatable shelf 160. At this time, a cut portion 173 cut off so that one region of the supporting member 171 can be accommodated can be formed on one side of the rotatable shelf 160.

The rotary shaft 175 protrudes outside at the both ends of the supporting member 171. The shaft hole 165 is penetratingly formed on the both side walls of the cut portion 173 of the rotatable shelf 160 so that the rotary shaft 175 can be accommodated therein. The shaft hole 165 is formed of a slot having a larger length than the diameter of the rotary shaft 175 so that the rotary shaft 175 is accommodated in the shaft hole 165 to move between the first position 166*a* and the second position 166*b*. Here, in the first position 166*a*, the internal space is vertically partitioned off so that the rotatable shelf 160 is horizontally provided and that the food items can be accommodated on the rotatable shelf 160 and, in the second position 166*b*, the rotatable shelf 160 is vertically provided to be vertically opened like when the food items having a larger height is accommodated.

In the shaft hole 165, formed is a guiding portion 168 for guiding the rotary shaft 175 so that the rotary shaft 175 is positioned in one of the first position 166*a* and the second position 166*b*. The guiding portion 168 can be in the form of an arc having the radius of curvature corresponding to the external diameter of the rotary shaft 175. The central region of the guiding portion 168 can be formed so that the internal width thereof is reduced and that the rotary shaft 175 can pass through the guiding portion 168 with relatively large contact force. Therefore, it is possible to prevent the rotatable shelf 160 from being unexpectedly moved.

On the other hand, a combination supporting unit 180 can be formed on one wall of the rotatable shelf 160 so that the rotatable shelf 160 can be vertically supported.

The combination supporting unit 180 can consist of a combination protrusion 182 that protrudes from one of the rotatable shelf 160 and the fixed shelf 140 toward the other and a combination protrusion accommodating portion 192 in which the combination protrusion 182 is accommodated.

The combination protrusion 182 is formed on one side wall of the rotatable shelf 160 and the combination protrusion accommodating portion 192 is formed in the fixed shelf 140. Accordingly, the combination protrusion 182 is inserted into the combination protrusion accommodating portion 192 in the horizontal direction so that the rotatable shelf 160 can be prevented from being moved upward and downward.

Here, only one of an upper supporting portion 191 and a lower supporting portion 193 that form the combination protrusion accommodating portion 192 can be formed so that the rotatable shelf 160 can be supported only on one side of the upper side and the lower side.

The upper supporting portion 191 can be formed to have a smaller protrusion length than the protrusion length of the lower supporting portion 193. Therefore, the horizontal movement distance of the rotatable shelf 160 can be reduced.

Protrusion combining units 181 and 183 are formed in the rotatable shelf 160 to correspond to the degrees of protrusion of the upper supporting portion 191 and the lower supporting portion 193.

On the other hand, fixing units 210 can be provided in the rotary shaft 175 and the shaft hole 165, respectively, to prevent the rotatable shelf 160 from being unexpectedly rotated downward when the rotatable shelf 160 is vertically provided.

The fixing unit 210 can consist of a locking protrusion 214 that protrudes toward one of the rotary shaft 175 and the shaft hole 165 toward the other and a locking protrusion accommodating portion 224 in which the locking protrusion 214 is accommodated.

The locking protrusion 214 that protrudes outside is formed on the rotary shaft 175 and the locking protrusion accommodating portion 224 is formed in the shaft hole 165. A protrusion unit 212 that protrudes outside in the radial direction of the rotary shaft 175 to have a width wider than that of the locking protrusion 214 is formed around the locking protrusion 214. A recessed unit 222 recessed outside in the horizontal direction so that the protrusion unit 212 can be accommodated and combined is formed in the shaft hole 165 to correspond to the protrusion unit 212.

Here, the locking protrusion 214 and the protrusion unit 212 are formed to protrude toward the upper part of the rotary shaft 175 in the drawing and the recessed unit 222 and the locking protrusion accommodating portion 224 are formed in the first position 166*a* of the shaft hole 165 to be recessed to the left in the drawing.

Figure 3:
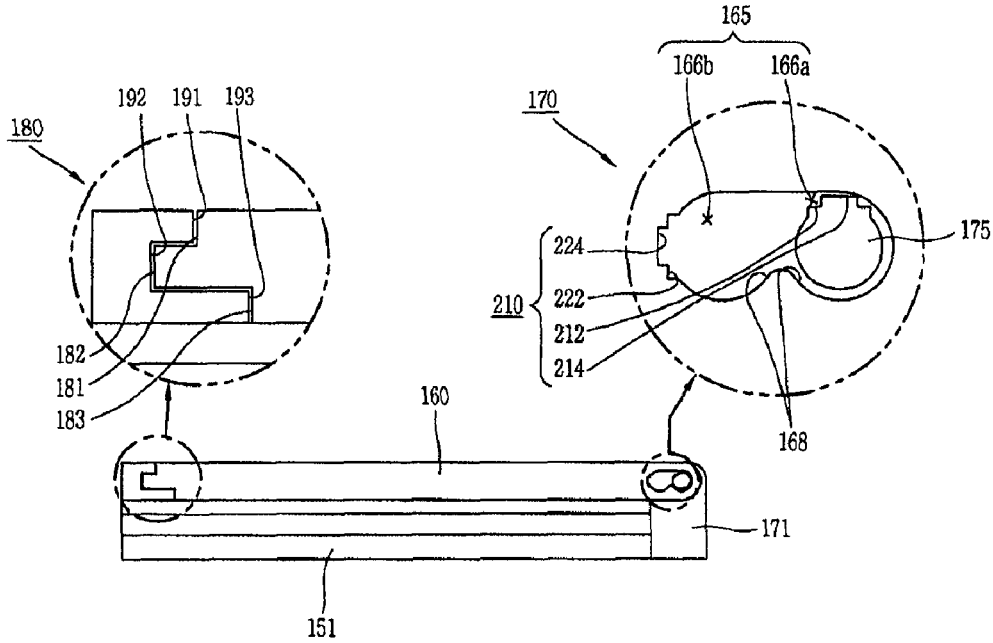
FIG. 3 is a side view of the rotatable shelf region of FIG. 2.
Figure 4:
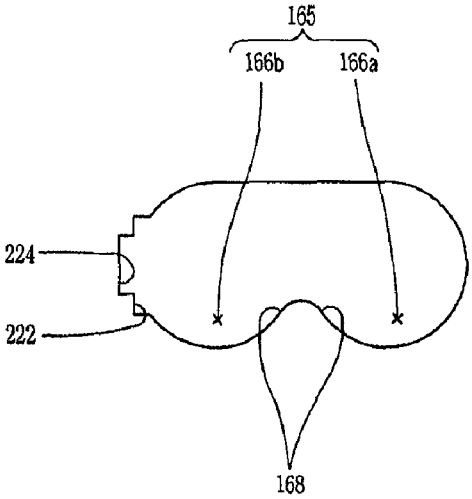
FIG. 4 is an enlarged view of the shaft hole of FIG. 3.
Figure 5:
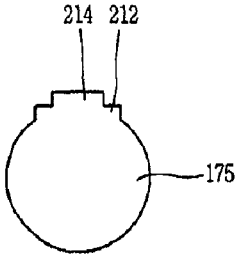
FIG. 5 is an enlarged view of the rotary shaft of FIG. 3.

Due to such a structure, when the food items is to be accommodated on the rotatable shelf 160, as illustrated in FIG. 3, the rotatable shelf 160 is horizontally provided and is pressed toward the fixed shelf 140 to slide. Then, the combination protrusion 182 of the rotatable shelf 160 is inserted into the combination protrusion accommodating portion 192 and is vertically supported to be prevented from being vertically moved. At this time, the rotary shaft 175 is provided in the first position 166*a* of the shaft hole 165.

Figure 6:
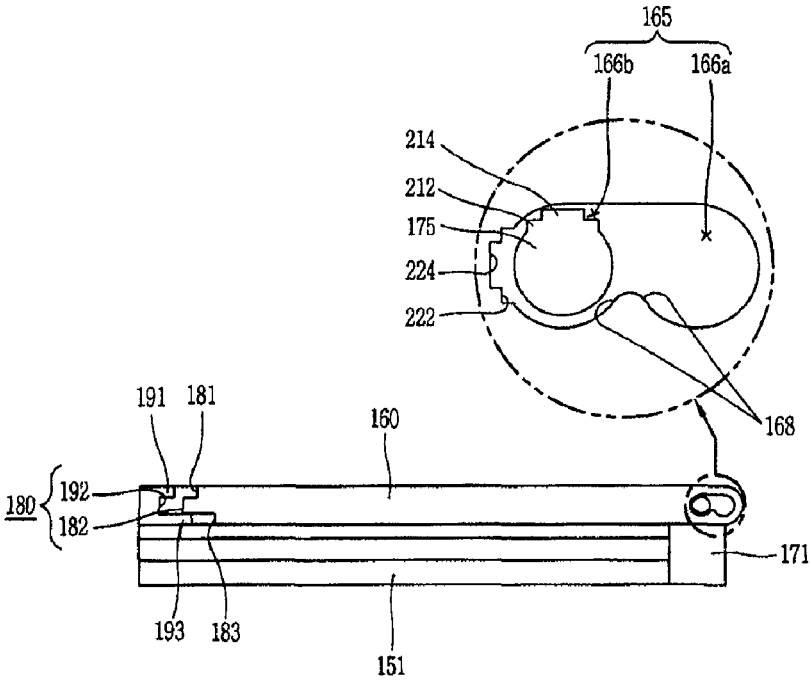
FIG. 6 is a view illustrating a state in which the rotatable shelf of FIG. 3 horizontally moves.

On the other hand, when a bottle having a relatively large height is to be erected on the lower shelf of the rotatable shelf 160, first, as illustrated in FIG. 6, the rotatable shelf 160 is horizontally pressed so that the combination protrusion 182 is separated from the combination protrusion accommodating portion 192 to slide away from the fixed shelf 140. At this time, the rotary shaft 175 is positioned in the second position 166*b* of the shaft hole 165.

Figure 7:
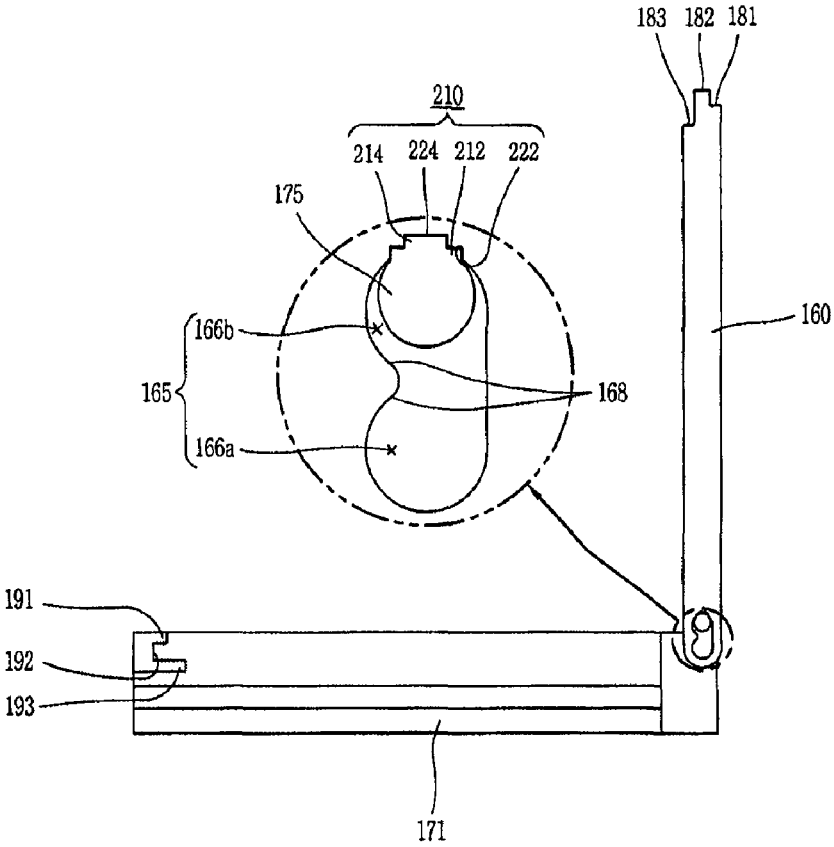
FIG. 7 is a view illustrating a state in which the rotatable shelf of FIG. 6 is vertically provided.

Then, when the rotatable shelf 160 is pressed upward, as illustrated in FIG. 7, the rotatable shelf 160 is vertically provided to rotate upward about the rotary shaft 175. At this time, the locking protrusion 214 and the protrusion unit 212 are inserted into and combined with the locking protrusion accommodating portion 224 and the recessed unit 222 to prevent the rotatable shelf 160 from being unexpectedly rotated downward.

When the rotatable shelf 160 is vertically provided, the bottle is to be inserted into the upper surface of the lower shelf of the rotatable shelf 160 in back and forth direction.

On the other hand, when the rotatable shelf 160 is to be horizontally provided, in the state where the rotatable shelf 160 is pressed upward so that the locking protrusion 214 and the protrusion unit 212 are separated from the locking protrusion accommodating portion 224 and the recessed unit 222, the rotatable shelf 160 is to be rotated downward.

In the above-described and illustrated embodiment, one rotatable shelf is provided. However, a plurality of rotatable shelves can be provided.

In addition, in the above-described and illustrated embodiment, one rotatable shelf is provided on the single plane. However, a plurality of rotatable shelves can be provided.

In addition, in the above-described and illustrated embodiment, the fixed shelf is provided on one side of the rotatable shelf and the combination supporting unit for combining the rotatable shelf with the fixed shelf is formed to support the rotatable shelf. However, the combination supporting unit can be formed in the main body so that the rotatable shelf is horizontally supported.

In addition, in the above-described and illustrated embodiment, the fixed shelf is provided on the same plane as the rotatable shelf on one side of the rotatable shelf when the rotatable shelf is horizontally provided. However, the rotatable shelf can be independently provided. In this case, the space between common shelves is vertically partitioned off to be smaller so that the food items having a smaller size can be kept on the rotatable shelf. Therefore, the internal space can be effectively utilized.

It will also be apparent to those skilled in the art that various modifications and variations can be made in the present invention without departing from the spirit or scope of the invention. Thus, it is intended that the present invention cover modifications and variations of this invention provided they come within the scope of the appended claims and their equivalents.

As described above, according to the present invention, in accordance with the size and/or the shape, in particular, the height of the food items accommodated in the storage space, the storage space can vary so that the space can be effectively utilized.

In addition, according to the present invention, since the storage space of the main body of the refrigerator can easily vary with the size, in particular, the height of the food items to be accommodated, the upper shelf needs not be separated and the food items needs not be laid down, which is convenient.

In addition, according to the present invention, since the fixed shelf is provided on one side of the rotatable shelf in right and left directions of the storage space and the rotatable shelf is vertically supported, the food items can be easily accommodated and the food items can be stably accommodated on the rotatable shelf.

In addition, according to the present invention, since the fixing units engaged with each other when the rotatable shelf is vertically provided are included, it is possible to prevent the rotatable shelf from being unexpectedly rotated.

The invention claimed is:

1. A refrigerator comprising:
a main body in which a storage space is formed;
a frame mounted on the main body;
a supporting member fixed to the frame; and
a rotatable shelf apparatus installed to the frame,
wherein the rotatable shelf apparatus comprises:
a rotatable shelf provided in the storage space to be rotated in a vertical direction; and
a rotation supporting unit fixedly provided in the storage space to rotatably support the rotatable shelf, and
wherein the rotation supporting unit comprises:
a rotary shaft provided in the supporting member;
a shaft hole formed in the rotatable shelf; and
a fixing unit provided in the rotary shaft and the shaft hole for fixing the rotatable shelf in a vertical direction.

2. The refrigerator as claimed in claim 1, wherein the supporting member is provided on one side of the rotatable shelf in an axial direction.

3. The refrigerator as claimed in claim 1, wherein
the shaft hole includes a first position and a second position, and
the rotary shaft is accommodated in the shaft hole to be at a first position or a second position as the shaft hole moves in a back and forth direction of the main body.

4. The refrigerator as claimed in claim 3, wherein the rotation supporting unit is provided in the back and forth direction of the main body.

5. The refrigerator as claimed in claim 4, wherein the rotatable shelf has a width smaller than an entire width of the storage space in right and left directions, and
wherein a fixed shelf is provided on one side of the rotatable shelf in right and left directions of the storage space.

6. The refrigerator as claimed in claim 5, wherein a lower supporting portion for supporting the rotatable shelf on the lower side of the rotatable shelf is formed in the fixed shelf.

7. The refrigerator as claimed in claim 6, wherein an upper supporting portion for preventing the rotatable shelf from being rotated upward on the upper side of the rotatable shelf is formed in the fixed shelf.

8. The refrigerator as claimed in claim 5, wherein a combination supporting unit is formed in the fixed shelf so that the rotatable shelf can be horizontally combined at the first position.

9. The refrigerator as claimed in claim 8, wherein the combination supporting unit comprises:
a combination protrusion that horizontally protrudes from one of the rotatable shelf and the fixed shelf; and
a combination groove formed at the other so that the combination protrusion can be inserted therein.

10. The refrigerator as claimed in claim 9, wherein the combination protrusion includes:
a lower supporting portion formed in the fixed shelf for supporting the rotatable shelf on the lower side of the rotatable shelf; and
an upper supporting portion formed in the fixed shelf for preventing the rotatable shelf from being rotated upward on the upper side of the rotatable shelf.

11. The refrigerator as claimed in claim 3, wherein the fixing unit comprises:
a locking protrusion that protrudes from one of the rotary shaft and the shaft hole toward the other; and
a locking groove formed in the other so that the locking protrusion can be accommodated therein at the second position.

12. The refrigerator as claimed in claim 3, wherein a guiding portion for guiding the rotary shaft to be positioned in one of the first position and the second position is formed in the shaft hole.

13. The refrigerator as claimed in claim 12, wherein the guiding portion is in the form of an arc having a radius of curvature corresponding to an external diameter of the rotary shaft.

14. A shelf apparatus, comprising:
a frame mounted within a main body of a refrigerator;
a supporting member fixed to the frame;
a fixed shelf fixed on the frame; and
a rotatable shelf apparatus installed to the frame,
wherein the rotatable shelf apparatus comprises:
a rotatable shelf provided in the storage space to be rotated in a vertical direction; and
a rotation supporting unit fixedly provided in the storage space to rotatably support the rotatable shelf, and
wherein the rotation supporting unit comprises:
a rotary shaft provided in the supporting member;
a shaft hole formed in the rotatable shelf; and
a fixing unit provided in the rotary shaft and the shaft hole for fixing the rotatable shelf in a vertical direction.

* * * * *